United States Patent [19]

Bruneau

[11] Patent Number: 4,742,598

[45] Date of Patent: May 10, 1988

[54] VERTICAL FILING CABINET HAVING A DEVICE FOR BALANCING AND HOLDING LID IN A SAFETY POSITION

[75] Inventor: Alain Bruneau, Montferrand Le Chateau, France

[73] Assignee: Alpia S.A., Besancon, France

[21] Appl. No.: 917,656

[22] Filed: Oct. 9, 1986

[30] Foreign Application Priority Data

Oct. 22, 1985 [FR] France ..... 85 16075

[51] Int. Cl.[4] ..... E05F 1/08; E05D 11/10; B65D 43/24

[52] U.S. Cl. ..... 16/286; 16/289; 16/292; 16/322; 217/60 B; 220/335

[58] Field of Search ..... 16/1 C, 286, 289, 292, 16/306, 322, 327, 332, 335, 387, 85; 217/60 B, 60 R, 61; 220/334, 335; 49/394

[56] References Cited

U.S. PATENT DOCUMENTS

| | | | |
|---|---|---|---|
| 881,492 | 3/1908 | Schiller | 217/61 |
| 1,357,655 | 11/1920 | Sandell | 16/289 |
| 2,683,447 | 7/1954 | Pollock | 16/306 |
| 3,191,217 | 6/1965 | Squire | 16/289 |
| 3,643,291 | 2/1972 | Clark | 16/289 |

FOREIGN PATENT DOCUMENTS

| | | | |
|---|---|---|---|
| 1080505 | 8/1967 | United Kingdom | 16/292 |

*Primary Examiner*—Nicholas P. Godici
*Assistant Examiner*—Edward Brown
*Attorney, Agent, or Firm*—Robert E. Burns; Emmanuel J. Lobato

[57] ABSTRACT

Device for balancing a lid of a suspended plan filing cabinet, comprising a stay (4) fixed at one end (40) on a pivot pin (5) fastened to the lid (1), the other end (41) being free, said stay being pulled towards the top of the cabinet by a spring (6) compensating the weight of the lid. The stay is guided by a roller (7) free to turn on a pin (8) fastened to the frame (2). This stay has a notch (9) which is entered by the roller (7) in order to hold the lid open, and a notch (10) holding the lid closed. Means of adjusting the tension of the spring (6) make it possible to fix a safety position ($\alpha$) before the complete closure of the lid.

2 Claims, 1 Drawing Sheet

VERTICAL FILING CABINET HAVING A DEVICE FOR BALANCING AND HOLDING LID IN A SAFETY POSITION

FIELD OF THE INVENTION

The invention relates to a device for balancing and holding in a safety position the lid of a vertical plan filing cabinet, said lid being connected to the cabinet frame by means of hinges, and said device comprising a stay fixed at one end on a pivot pin fastened to the lid while its other end is free, the stay being pulled towards the top of the cabinet by at least one spring compensating the weight of the lid and having one anchoring point on the top of the cabinet and the other on the free end of the stay, while a roller free to turn on a pin fastened to the cabinet frame guides the stay and immobilizes the lid in its open and closed position.

PRIOR ART

Most known plan filing cabinets have a lid usually consisting of a one-piece panel mounted on hinges or pivots.

This lid, which must permit the insertion of the widest plans in normal use, is opened by hand, but the weight of the lid is sometimes compensated by a spring system.

A device holds the lid in the open position.

In the event of accidental closing, the compensation springs do not prevent the operator's fingers from being caught.

In order to avoid such accidents an overcompensated lid, which in the event of falling will be stopped before it closes completely, must be designated.

The disadvantage of a device of this kind is that the lid would always be slightly open and consequently an additional operation would be required to hold the lid closed by means of a bolt or lock.

SUMMARY OF THE INVENTION

The present invention seeks to provide filing cabinet lids with a device serving four concomitant functions:

- overcompensation by springs of the weight of the lid,
- holding the lid in the open position,
- stopping the lid a few centimeters before complete closure in the event of accidental falling,
- holding the lid in the closed position, thus avoiding in normal use the constant utilization of the lock.

To this end, the device according to the invention is characterized by the fact that the stay is provided with at least one first notch, which is entered by the rotating roller in order to hold the lid in the open position, and a second notch, which is entered by the rotating roller in order to hold the lid in its closed position, and by the fact that means of adjusting the tension of the compensation spring make it possible to fix a safety position before the complete closure of the lid.

The principal advantage supplied by a device of this kind consists of the simplicity of its construction and the fact that it is possible to adjust as desired the safety position of the lid (stopping before closure) without having to accept any slackening of the spring or an increase of the weight of the lid not allowed for in its design.

The lid is thus balanced with an indexed open position, and provided with a safety system having an indexed closed position.

The special shape of the hinges, which is defined in claim 2, enables the lid to be opened without either the lid itself or the hinges projecting beyond the rear face of the cabinet in any position of the lid, so that the cabinet can be fixed against a wall or cabinets can be fixed back to back.

BRIEF DESCRIPTION OF THE DRAWINGS

Other advantages will emerge from the following description of a preferred embodiment, which is given by way of non-limitative example, and from the accompanying drawings, in which.

DESCRIPTION OF THE PREFERRED EMBODIMENT

Figure 1:
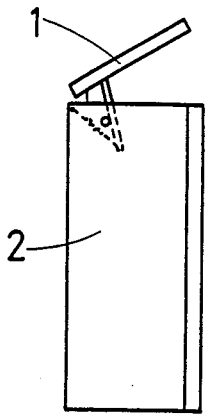
FIG. 1 is a side view of a suspended plan filing cabinet.

FIG. 1 shows a side view of a suspended plan filing cabinet consisting essentially of a lid 1, which opens and closes down onto a frame 2.

Figure 2:
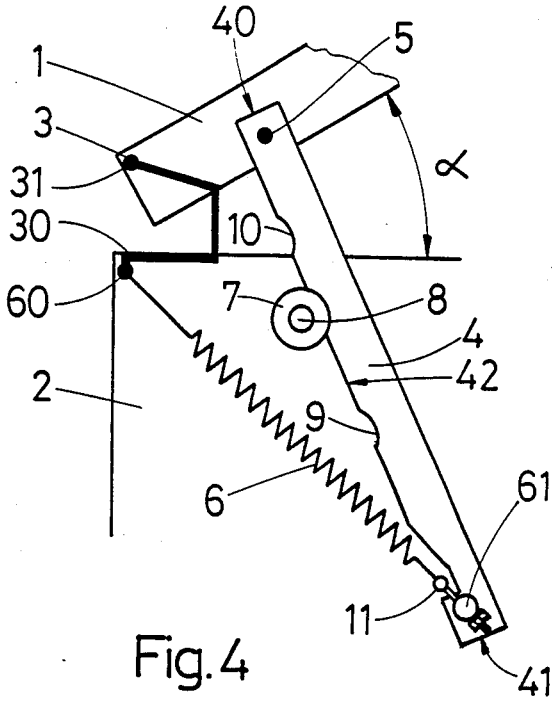
FIG. 2 is a diagram of the device in the safety position.

FIG. 2 shows the device according to the invention mounted on at least one side of the lid, which is connected to the frame 2 by two hinges 3 of the shape of an open-sided trapezoid.

These hinges 3 are fixed on one side by bolting or welding at a point 30 on the frame 2, and on the other side by a pivot 31 on the lid 1. Their trapezoidal shape enables the lid in its opening movement to turn above the top plane of the cabinet and to give complete-clear access for the filing of plans, while in the closed position the outer edge of the lid is in perfect alignment with the corresponding edge of the frame, without any external rough parts or hinges, so that the cabinet can be rested against a vertical wall.

The device for balancing and holding the lid 1 in a safety position has the following constitution:

a stay 4 is fixed at one end 40 on a pivot pin 5 fastened to the lid 1, its other end 41 being free;

a spring 6 compensating the weight of the lid 1 is stretched between an anchorage point 60 at the top of the frame 2, in the corner supporting the hinge 3 of the lid, and an anchorage point 61 on the free end 41 of the stay 4.

The pull applied by the spring 6 to the free end 41 of the stay 4 assists in the opening of the lid and also in holding the stay 4 bearing against a guide roller 7 which is free to turn on a pin 8 fastened to the frame 2.

Figure 3:
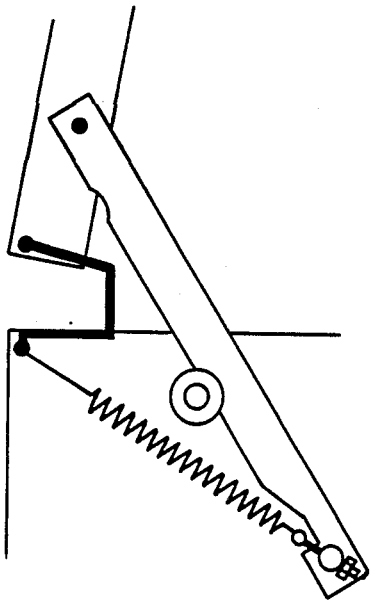
FIG. 3 is a diagram of the device in the "Lid open" position.

A notch 9 formed in that edge 42 of the stay which faces the spring 6 holds the lid in the open position. The situation of this notch defies the angle of opening of the lid (FIG. 3).

Figure 4:
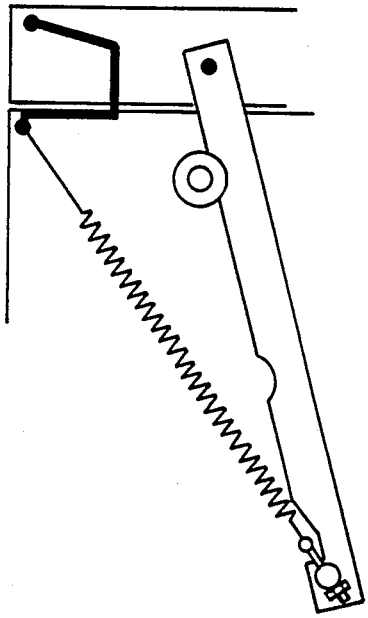
FIG. 4 is a diagram of the device in the "Lid closed" position.

A second notch 10 formed on the same edge 42 of the stay 4, closer to the point where the latter is pivoted on the pin 5, holds the lid in the closed position (FIG. 4).

The overcompensation of the weight of the lid 1 is adjusted by means of a screw 11, which makes it possible to vary the tension of the spring from the anchorage point 61 on the free end 41 of the stay 4. This adjustment permits accurate determination of the safety angle ($\alpha$) which must be left open in the event of the abrupt falling of the lid 1.

Since the lid remains slightly open because of the overcompensation, additional pressure applied by the operator will cause the roller 7 to enter the notch 10; the "lid closed" position is thus obtained without resorting constantly to the action of a lock, the function of which is now limited to the locking of the lid by means of a key.

I claim:

1. A vertical filing cabinet having an open top, a lid, hinges connecting said lid with said cabinet for pivotal movement about a horizontal axis disposed above an upper edge of a rearwall of said cabinet between open and closed position, and a device for controlling the opening and closing of said lid, said device comprising, a roller rotatably mounted on a side wall of said cabinet for rotation about a horizontal axis disposed forwardly and below the pivotal axis of the lid, a straight stay having an upper end pivotally connected with said lid forwardly of the pivotal axis of said lid and having an edge engageable with said roller, a tension spring having an upper end connected with an upper rear portion of said cabinet and a lower end connected with a lower end of said stay, said spring acting on said stay to bias said stay toward said roller and to compensate the weight of said lid, said stay having in an edge engageable with said roller a first notch positioned to engage said roller when said lid is in fully open position and a second notch engageable with said roller when the lid is in fully closed position, said tension device being adjustable to overcompensate the weight of said lid so that in a state of equilibrium said spring supports the lid in a partially open position with said roller engaging said stay between said first and second notches.

2. A filing cabinet according to claim 1, in which said hinges have the shape of an open-sided trapezoid with a lower side fixedly mounted on said cabinet and an upper side pivotally connected with said lid.

* * * * *